US005803641A

United States Patent [19]

Nützel

[11] Patent Number: 5,803,641

[45] Date of Patent: Sep. 8, 1998

[54] DEVICE FOR USE IN INSERTING INDIVIDUAL TENSION ELEMENTS OF A FREELY TENSIONED MEMBER INTO A TUBULAR SHEATHING

[75] Inventor: Oswald Nützel, Munich, Germany

[73] Assignee: Dyckerhoff & Widmann Aktiengesellschaft, Munich, Germany

[21] Appl. No.: 627,088

[22] Filed: Apr. 3, 1996

[30] Foreign Application Priority Data

Apr. 15, 1995 [DE] Germany ..... 295 06 476 U

[51] Int. Cl.[6] ..... B25G 3/00

[52] U.S. Cl. ..... 403/20; 403/24; 403/45; 14/22

[58] Field of Search ..... 14/22, 23; 403/43, 403/47, 20, 297, 307, 24, 45; 411/60, 61, 55, 38; 254/134.3 FT; 604/104, 105, 106, 107, 108, 109

[56] References Cited

U.S. PATENT DOCUMENTS

| | | | |
|---|---|---|---|
| 1,120,368 | 12/1914 | Booraem et al. | 403/371 X |
| 1,992,978 | 3/1935 | Wilson et al. | 403/43 X |
| 3,479,081 | 11/1969 | Schaaf | 411/38 X |
| 4,416,572 | 11/1983 | Black | 411/38 |
| 4,468,146 | 8/1984 | Nutzel et al. | 14/21 |
| 4,473,915 | 10/1984 | Finsterwalder | 14/21 |
| 4,648,147 | 3/1987 | Zimmermann et al. | 14/21 |
| 4,828,439 | 5/1989 | Giannuzzi | 411/38 X |
| 5,074,871 | 12/1991 | Groshong | 604/107 X |

FOREIGN PATENT DOCUMENTS 3437108 9/1988 Germany .

*Primary Examiner*—Kenneth Dorner
*Assistant Examiner*—William L. Miller
*Attorney, Agent, or Firm*—Friedrich Kueffner

[57] ABSTRACT

A device to be used in inserting the individual tension elements of a freely tensioned tension member, for example, a stay cable for a cable-stayed bridge, into a tubular sheathing. A guide element to be attached to the front end of an individual element includes an expansion member whose diameter in its non-expanded state corresponds approximately to the diameter of the individual element, while the diameter in the expanded state is greater than the diameter of the individual element.

10 Claims, 7 Drawing Sheets

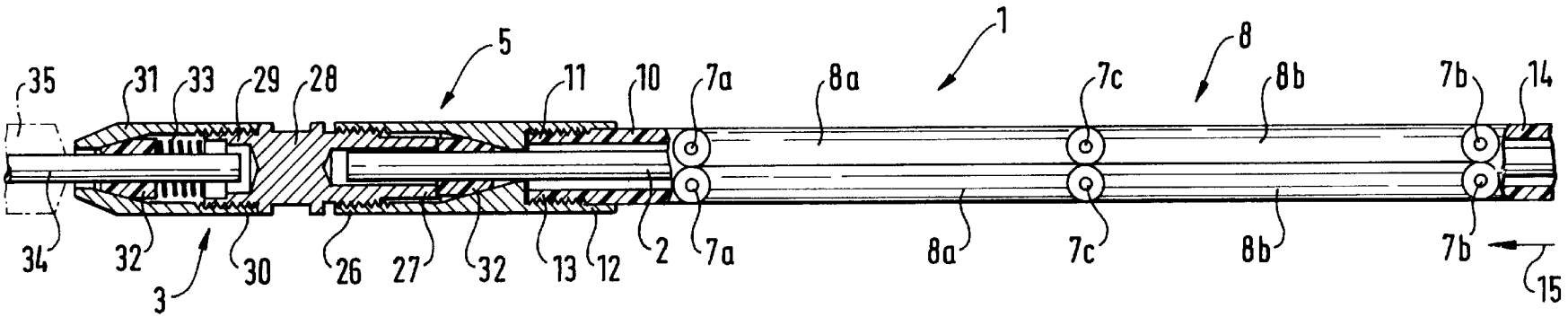
FIG. 1a
FIG. 1b
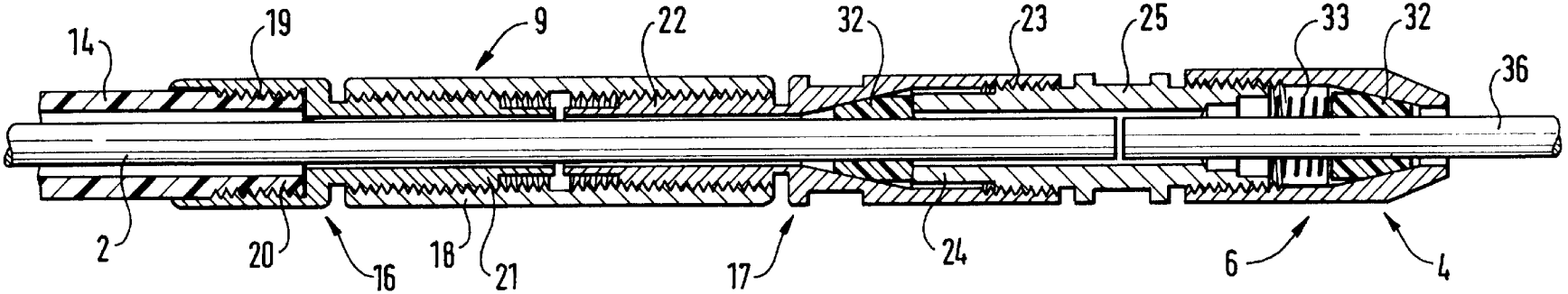

FIG. 3a
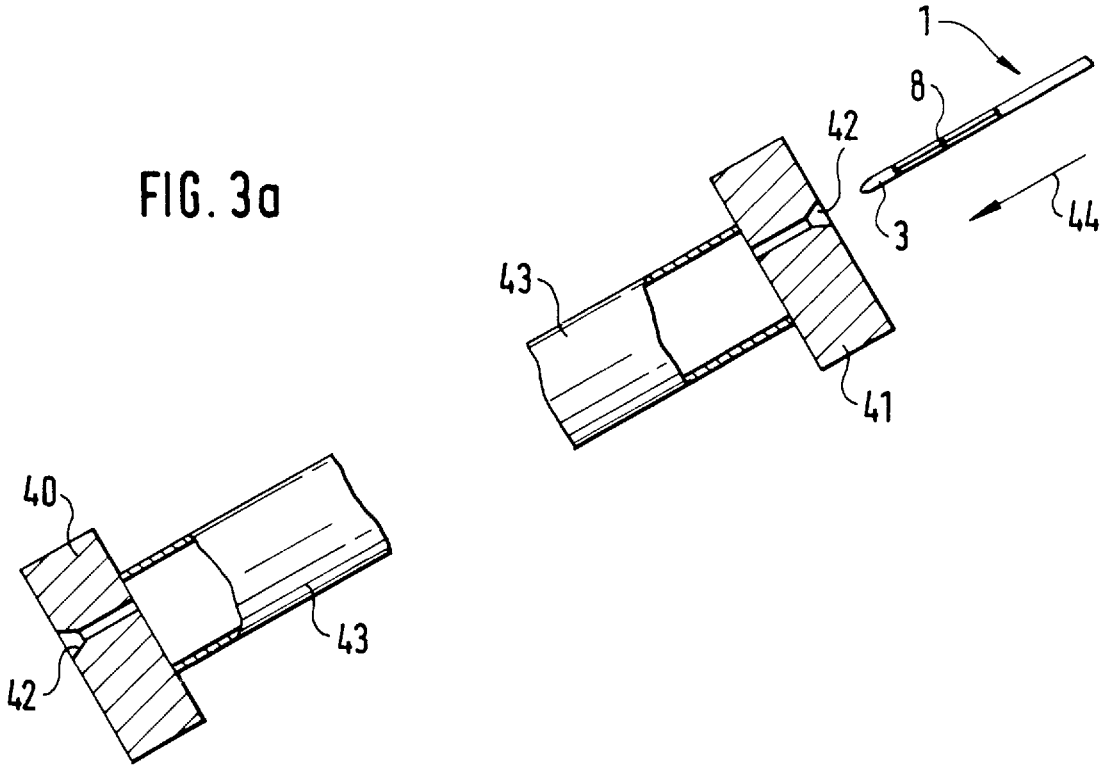
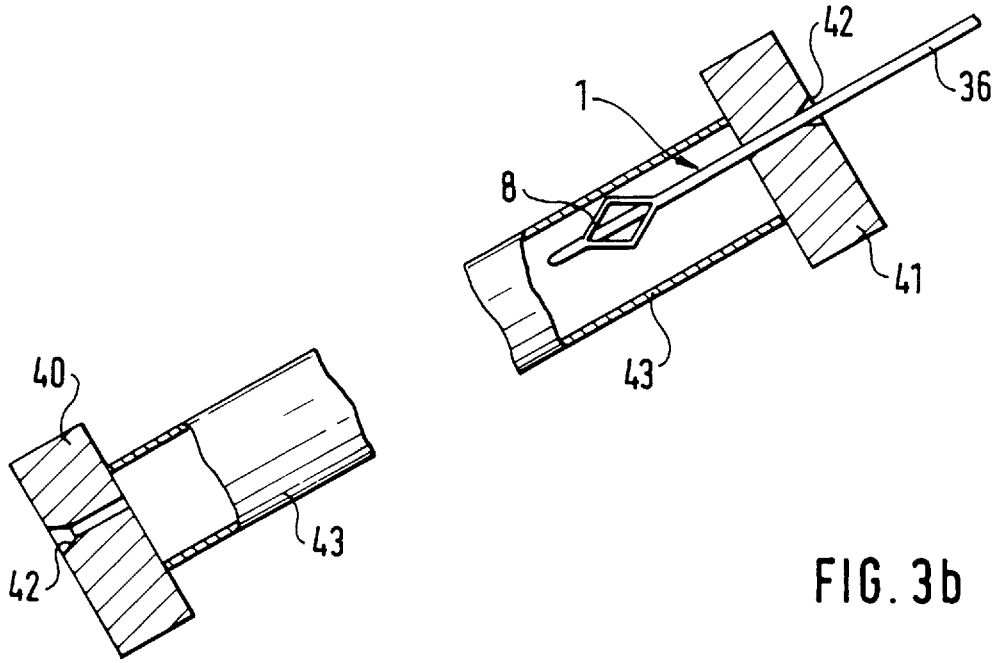
FIG. 3b

DEVICE FOR USE IN INSERTING INDIVIDUAL TENSION ELEMENTS OF A FREELY TENSIONED MEMBER INTO A TUBULAR SHEATHING

BACKGROUND OF THE INVENTION

1. Field of the Invention

The present invention relates to a device to be used in inserting the individual tension elements of a freely tensioned tension member, for example, a stay cable for a cable-stayed bridge, into a tubular sheathing.

2. Description of the Related Art

Tension members are frequently used in civil engineering for anchoring structural components; such tension members are, for example, stay cables for cable-stayed bridges or the like. Such tension members frequently are composed of a bundle of individual elements, such as, steel wires or steel strands, which, along the free length of the tension member, are together arranged in a tubular sheathing, wherein the individual elements are usually longitudinally movably guided through the respective structural components and are anchored at the outer sides of each of the structural components. The anchoring systems include an anchoring disc with conical bores through which the individual elements are passed and in which they are anchored by means of multi-part annular wedges. Along the free length of the tension member, the tubular sheathing may be a plastic pipe, for example, of polyethylene, or a steel pipe. In the anchoring range, the sheathing tube usually is an anchoring pipe of steel. The hollow space between the individual elements and the tubular sheathing is filled after tensioning of the individual elements by pressing a corrosion protection substance or a hardening material, for example, cement mortar, into the hollow space.

Particularly in stay cables of cable-stayed bridges, it is quite difficult to mount the heavy cables in the required inclined position between the anchoring devices for the cables in the girder supporting the roadway and at the top of the tower, frequently at great heights. If the stay cables are assembled on the work plane, for example, on the floor plate of the already finished bridge portion, the stay cables must be raised by means of appropriate lifting apparatus into the required inclined position and they must simultaneously be inserted into the lower and upper anchoring devices. Other possibilities are to initially tension the tubular sheathing to the full length thereof and to successively insert the individual elements, or to first tension the bundle of individual elements and then to surround this bundle by a sheathing which is composed, for example, of half shells.

It is always especially difficult to safely push the individual elements through the anchoring disc which is already mounted at its location and through the tubular sheathing, without jamming of the elements at a location which is not accessible.

It is particularly difficult to carry out a transition from the initially irregular arrangement of the individual elements within the tubular sheathing to the ordered arrangement within the anchoring area, i.e., when the individual elements are inserted from the rear into the conical bores in the anchoring disc while the individual elements are simultaneously spread apart.

In this connection, it has become known from DE 34 37 108 C2 to hold the actual anchoring disc initially by means of an auxiliary structure at a distance from the abutment body which is embedded in concrete, then to pass the individual elements through the anchoring plate and to provide the individual elements in the space between the anchoring disc and the abutment body with a so called insertion tip. This insertion tip is an approximately olive-shaped member whose diameter is greater than that of the individual elements and which has the purpose of holding together the individual wires of the strand during the insertion, on the one hand, and primarily to pave the way for the strand in the tubular sheathing through which the strand is then pushed until it reaches the oppositely located anchoring device. By appropriately selecting the diameter of this insertion tip, it should be made possible that the respective strand "floats" or travels on the already inserted individual elements, so that the elements are prevented from being intertwined.

This known solution has the disadvantage that, in order to be able to mount the insertion tip whose diameter is greater than the diameters of the bores in the anchoring disc, the anchoring disc must be held during the assembly at a distance from the opening of the tubular sheathing. Even though the special shape of the insertion tip ensures that a strand will find its way through the tubular sheathing, it is not always possible to reliably ensure that the insertion tip "floats" on the already inserted individual elements.

SUMMARY OF THE INVENTION

Therefore, it is the primary object of the present invention to make it possible to insert individual elements even when the anchoring disc is already mounted at its final location and to prevent with the greatest certainty possible that the individual elements will cross each other or will be intertwined in the spread-apart anchoring areas.

In accordance with the present invention, the guide element attached to the front end of an individual element includes an expansion member whose diameter in its non-expanded state corresponds approximately to the diameter of the individual element, while the diameter in the expanded state is greater than the diameter of the individual element.

The present invention provides a tool which can be connected at both ends to individual elements, particularly strands, which are to be inserted into anchoring devices, and which has sufficient stiffness, so that it can be passed through an anchoring disc, can grasp a strand and pull the strand through the anchoring disc. Because the tool, which may also be called an insertion lance, has the possibility of expansion, it is ensured the tool will always "float" or travel on the top of the already inserted individual elements, so that the individual elements are prevented from being intertwined as they are inserted.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 1*a* and 1*b* are partial sectional views of portions of an embodiment of the device according to the present invention, shown in the non-expanded state;

FIGS. 3*a*, 3*b*, 3*c* and 3*d* schematically illustrate the essential phases of operation when the individual elements are pulled in;

FIGS. 4*a*, 4*b*, 4*c* and 4*d* schematically illustrate the essential phases of operation when the individual elements are pushed in.

DESCRIPTION OF THE PREFERRED EMBODIMENTS

Figure 2A:
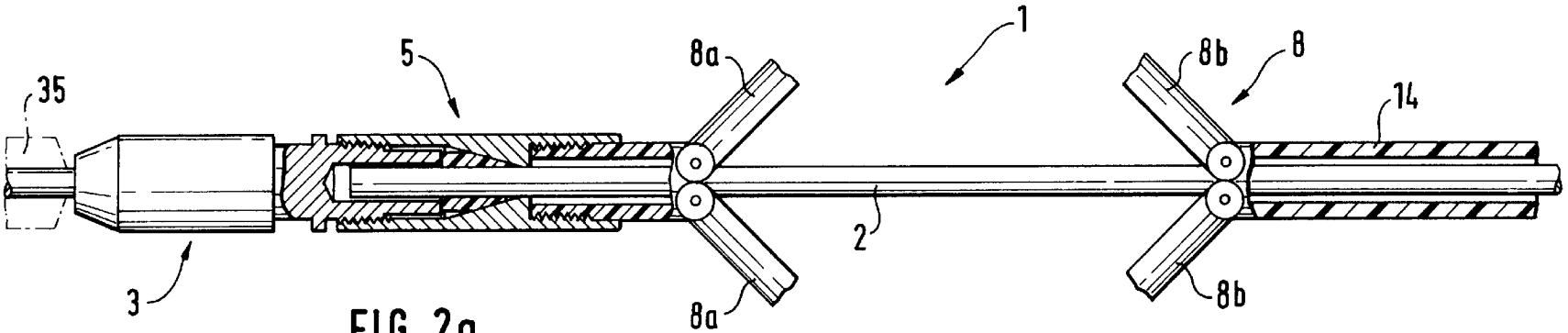
FIGS. 2*a* and 2*b* show the device of FIGS. 1*a* and 1*b* in the expanded state.
Figure 2B:
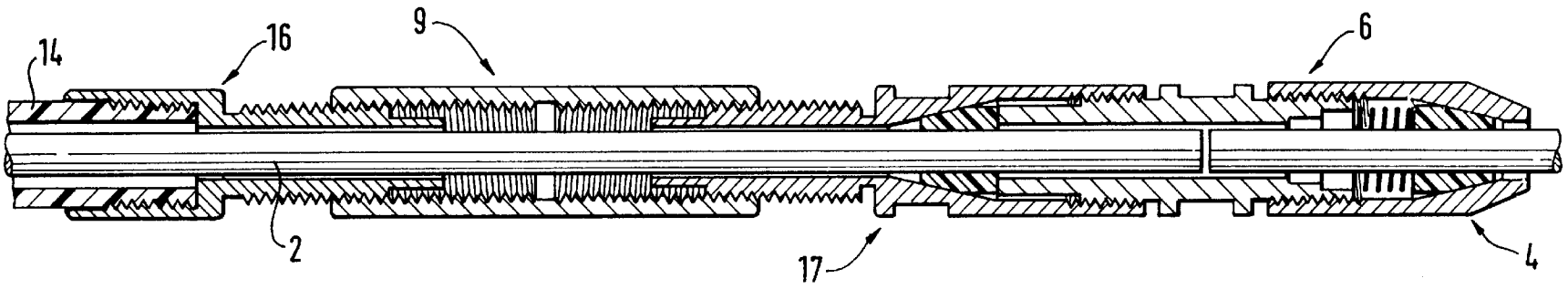

FIGS. 1*a* and 1*b* of the drawing show an embodiment of the device 1 according to the present invention, i.e., a so-called insertion lance. For better clarity, FIGS. 1*a* and 1*b* show different portions of the same embodiment.

The insertion lance 1 is primarily composed of two components which are movably connected to each other, namely, a central guide rod 2 extending through the entire device. The guide rod 2 is provided at its forward end 3 as well as at its rearward end 4 with a coupling element 5 or 6, respectively. The second component is an expansion member 8 which is fixed relative to the guide rod 2 only at one end, while the other end of the expansion member 8 is longitudinally displaceable relative to the guide rod 2. In the illustrated embodiment, the end at the forward coupling element 5 is fixed. An adjusting element 9 is mounted between the expansion member 8 and the rearward coupling element 6.

As can be seen in FIG. 1*a*, the expansion member 8 is composed of two pairs of expanding arms 8*a* and 8*b*. The expanding arms 8*a* are fastened at the forward end with hinges 7*a* to a bearing member 10 which with an end 11 with external thread and through the end 12 of a connecting member 13 is connected to the forward coupling element 5 and forms a fixed abutment in this manner. At their rearward ends, the expanding arms 8*a* and 8*b* are connected to one another through hinges 7*c* and the expanding arms 8*b* are connected at their rearward ends through hinges 7*b* to a pipe 14 which is slid over the guide rod 2.

The pipe 14 is composed of a material, for example, plastic material, which has sufficient stiffness with respect to pressure but advantageously is bendable, so that the pipe 14 can be bent to a certain extent as it is passed through the bores of an anchoring disc. The hinges 7*c* which connect the expanding arms 8*a* and 8*b* to one another are mounted slightly eccentrically relative to the longitudinal axis of the expanding arms 8*a* and 8*b*, so that an axial force applied in the direction of arrow 15 against the pipe 14 results in an expansion of the expanding arms 8*a* and 8*b*. The expanded position of the expanding member is illustrated in FIG. 2*a*.

In the simplest case, the expansion member 8 is composed of two pairs of expanding arms, as illustrated in the drawing. However, the expansion member 8 may also have a three-dimensional configuration comprised of three or more pairs of expanding arms; the expansion member 8 may also be surrounded by a cover of elastic material, such as rubber, or it may even be composed entirely of such a cover.

A possibility for applying an axial force onto the expansion member 8 is to use an adjusting element 9 having a right/left thread, as shown in FIG. 1*b*. The adjusting element 9 is composed of two connecting members 16, 17 and a threaded sleeve 18 connecting the members 16 and 17. The connecting member 16 is screwed with an end 19 having an internal thread onto an end 20 of the pipe 14 having a corresponding external thread. On the opposite side, the connecting member 16 has an end 21, wherein the threaded sleeve 18 is screwed onto the end 21. In the same manner, the connecting member 17 has an end 22, with the sleeve 18 being screwed onto the end 22, and an end 23 screwed onto the external thread of an end 24 of a connecting member 25 which forms a portion of the rearward coupling element 6.

The ends 21, 22 of the connecting members 16, 17 have threads with oppositely directed pitches; similarly, the threaded sleeve 18 is provided at both ends with threads having oppositely directed pitches. Consequently, by rotating the threaded sleeve 18 in one direction, the two connecting members 16 and 17 are moved apart from each other in axial direction. Since the rearward connecting member 17 is fixed relative to the guide rod 2 by being supported to the coupling member 6, the rotation of the sleeve 18 causes only the forward connecting member 16 to be displaced. This connecting member 16 transmits the displacement force through the pipe 14 as an axial force onto the expansion member 8, so that the arms 8*a* and 8*b* are expanded or spread apart, as shown in FIG. 2*a*. A rotation of the threaded sleeve 18 in the opposite direction results in a displacement of the pipe 14 in the opposite direction, so that the expanding arms 8*a* and 8*b* are again placed against the guide rod 2, as shown in FIG. 1*a*.

The two coupling elements 5 and 6 serve to couple the insertion lance 8 to a strand. The elements 5 and 6 are essentially of equal construction. Thus, the forward coupling element 5 includes the connecting member 13 which is equipped with an end 26 having an internal thread as well as a connecting member 28 with a threaded portion 27 onto which the end 26 of the connecting member 13 is screwed. At the forward end of the connecting member 28, the end 30 of a wedge-type sleeve 31 with internal thread is screwed onto an end 29 with external thread. An annular wedge 32 is mounted in a conical bore within the connecting member 13, wherein the end 27 of the connecting member presses against the end faces of the annular wedge 32. In this manner, a connection to the guide rod 2 can be effected which is tension-proof as well as compression-proof. On the opposite side, the annular wedge 32 is supported in the wedge-type sleeve 31 by means of a compression spring 33. In this manner, a rod, for example, the central rod 34 of a strand 35, which has been inserted from the outside into the interior of the wedge-type sleeve 31, can be anchored in a tension-proof manner.

In the rearward coupling element 6, shown in FIG. 1*b*, the end 23 of the connecting member 17 is in its interior again formed as a wedge-type sleeve with a conical bore for receiving an annular wedge 32 for fixing the guide rod 2 by screwing in the end 24 of the connecting member 15. The opposite end of this coupling element 6 is constructed in the same way as the forward end of the coupling element 5, so that also in this case an inserted rod 36, for example, the central rod of a strand, is anchored in a tension-proof manner.

The manner of operation of the device according to the present invention during the insertion of individual elements, particularly strands, is explained with the aid of FIGS. 3*a* to 3*d* and 4*a* to 4*d*.

FIGS. 3*a* through 3*d* show the pulling in of strands from below toward the top initially without tubing. A lower anchoring means 40 and an upper anchoring means 41 are schematically illustrated with their anchoring discs which are provided with conical bores 42 for passing therethrough the strands and for anchoring the strands by means of annular wedges. The illustrated situation corresponds to the manufacture of a stay cable for a cable-stayed bridge at the location of construction, wherein the lower anchoring means 40 is provided at the girder for the roadway and the upper anchoring means 41 is provided at the top of the tower. A tubing 43 is only shown at the anchoring means 40, 41 where the stay cable extends within the structure.

Figure 3C:
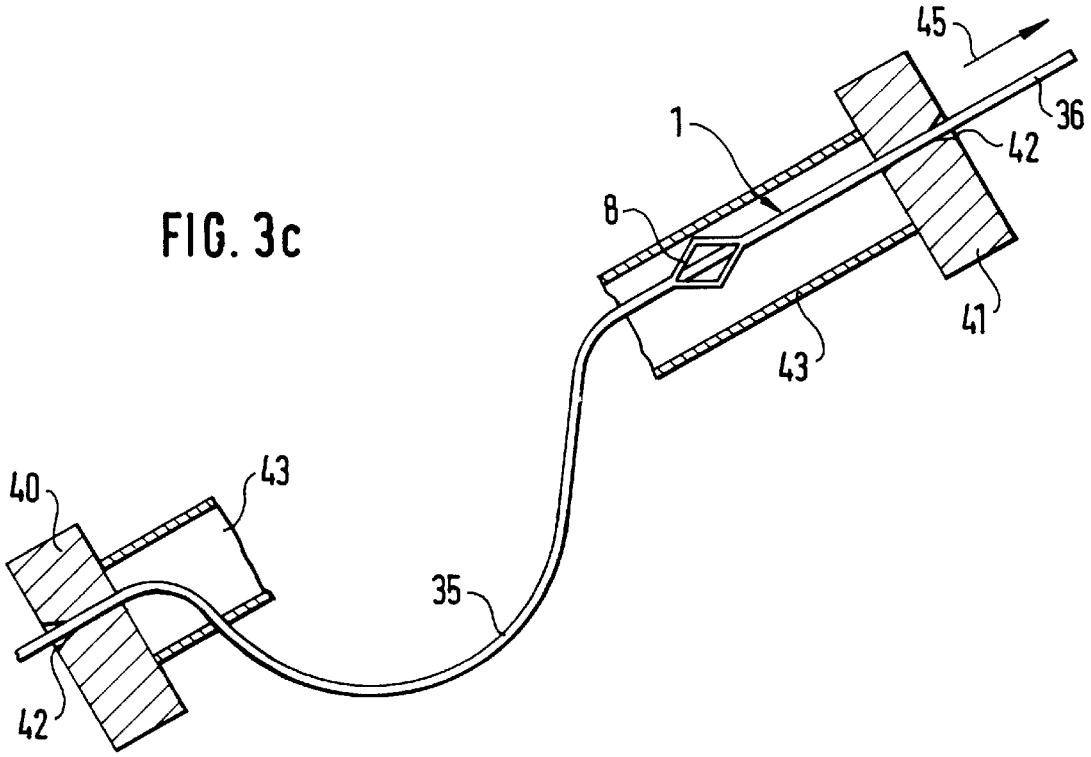

In the illustration of FIG. 3*a*, initially the insertion lance 1 according to the present invention is passed with non-expanded expansion member 8 in the direction of arrow 44 through a bore 42 of the upper anchoring means 41. Since, in that case, a strand has to be coupled only to the forward end 3 of the insertion lance 1, the guide rod 2 can extend through the rearward coupling element 6, which is a modification of the embodiment shown in FIG. 1*b*, and the guide rod 2 can have the length required for pulling in the strand. After passing the bore 42 or when the insertion lance 1 exits from the structure, the expansion member 8 is expanded by means of the adjusting element 9, as shown in FIG. 3*b*. By expanding the expansion member 8, which is shown turned by 90° for better clarity, it is made possible that the insertion lance 1 always "floats" above the already inserted strands, so that the strands cannot be intertwined. The strand 35 to be pulled in is then coupled to the insertion lance 1; this is effected by means of the exposed central wire 34 of the strand 7, as shown in FIG. 1*a*. The insertion lance 1 is then pulled back in the direction of arrow 45, as shown in FIG. 3*c*.

Figure 3D:
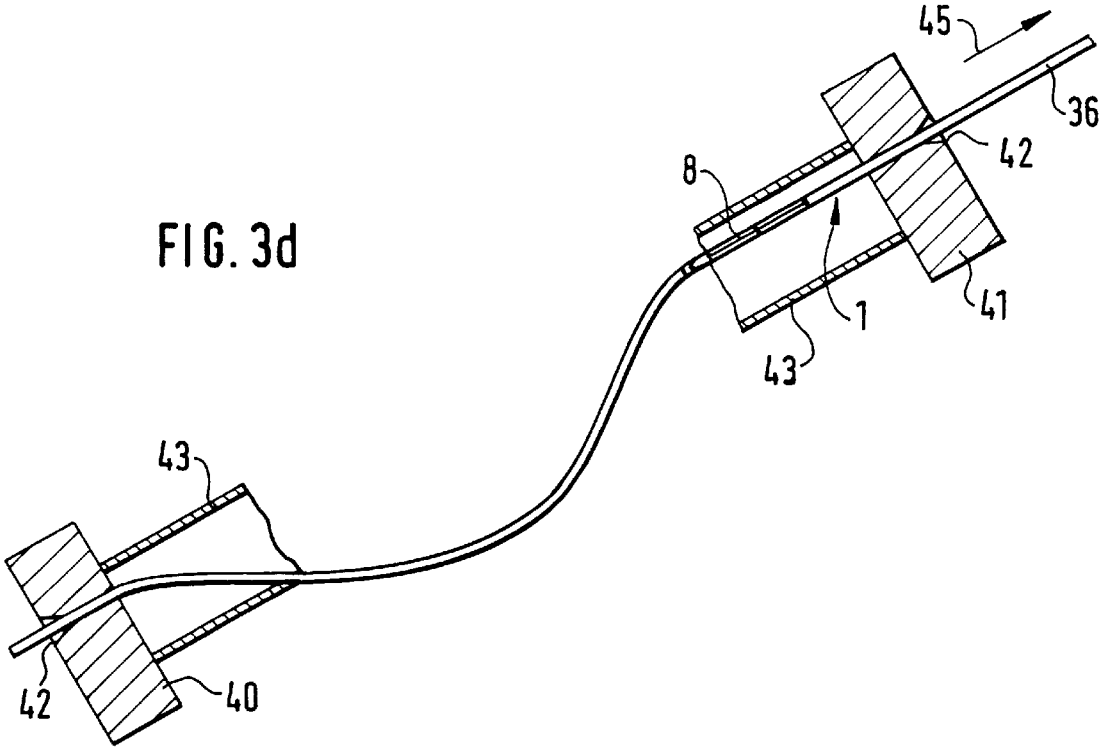

To ensure that the insertion lance 1 with the strand 35 can again pass through the bores 42 in the upper anchoring means 41, the expansion of the expansion member 8 is reversed by applying a tension in longitudinal direction by means of the adjusting element 9, so that the expanding arms 8*a* and 8*b* again rest against the guide rod 2, as shown in FIG. 3*d*. After the strand 35 has been anchored to the upper anchoring means 41, the insertion lance 1 can be uncoupled and used for the next pulling-in procedure. After all strands have been pulled in, the tubular sheathing in the form of half shells is mounted.

As illustrated in FIGS. 4*a* through 4*d*, the same mechanism can also be used for inserting strands into a tubing 43 which has already been put in place. In that case, because of the transverse forces occurring during the insertion at the expansion member 8, it is required to lock the expansion member 8 in the expanded position thereof. This is easily possible by using the adjusting element 9 described above in connection with FIG. 1*b*.

Figure 4A:
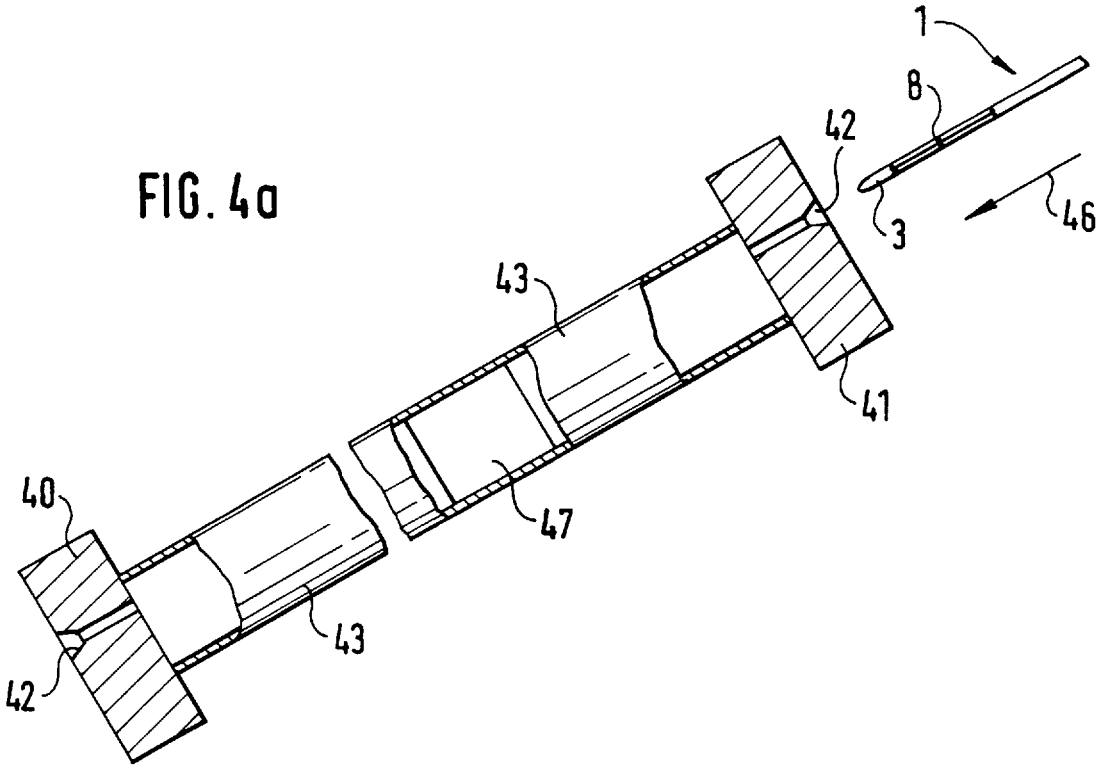
Figure 4B:
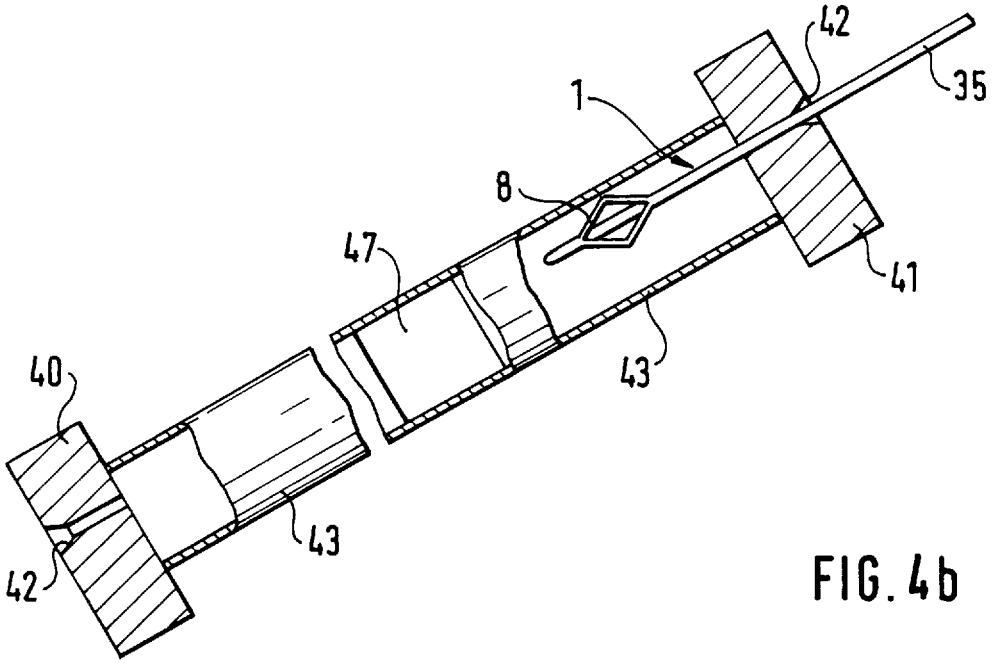

In this embodiment, the insertion lance 1 is initially also pushed in the direction of arrow 46 through the bore 42 in the upper anchoring means 41, as shown in FIG. 4*a*, and the expansion member 8 is expanded after passing the upper anchoring means 41, as shown in FIG. 4*b*. The strand 35, which in this case is fastened to the coupling element 8 shown in FIG. 1*b*, can be pushed from above in the direction of arrow 46 through the tubing 43. The expanded expansion member 8 ensures that the strand 35 "floats" on top of the already inserted strands. Since the strands are pulled from a coil during the insertion, a rotatable connecting element must be mounted, so that a transmission of a rotary movement onto the expansion member 8 is prevented.

Figure 4C:
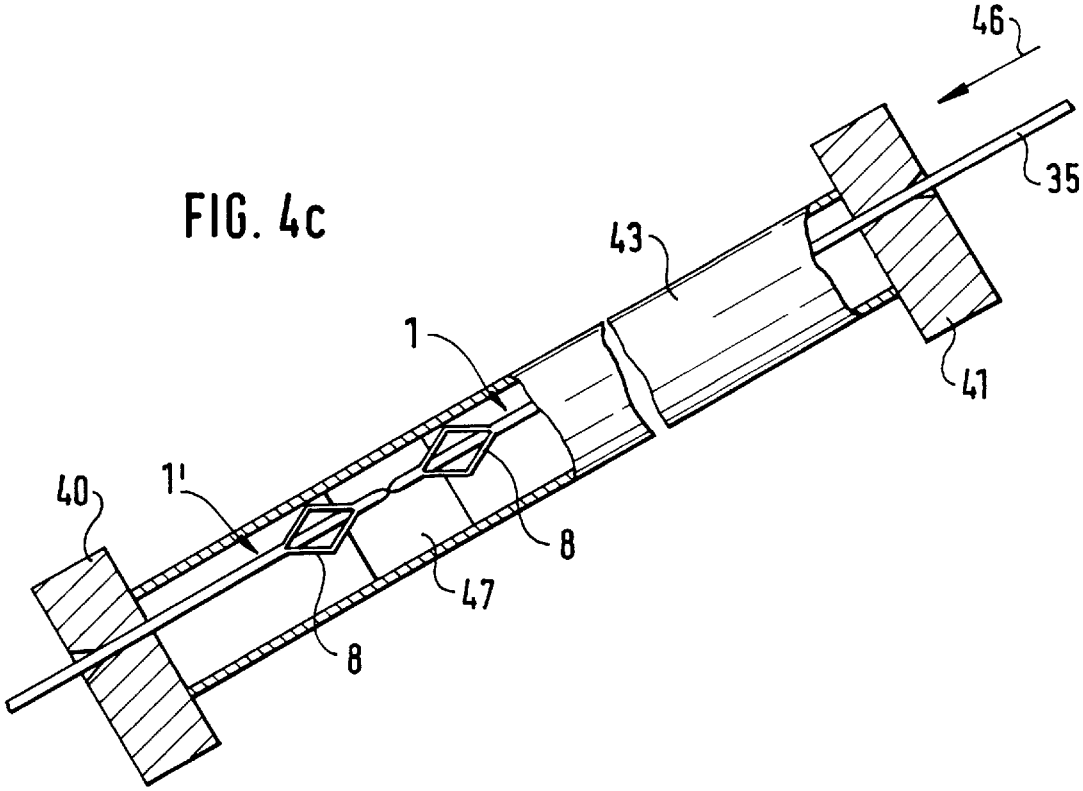
Figure 4D:
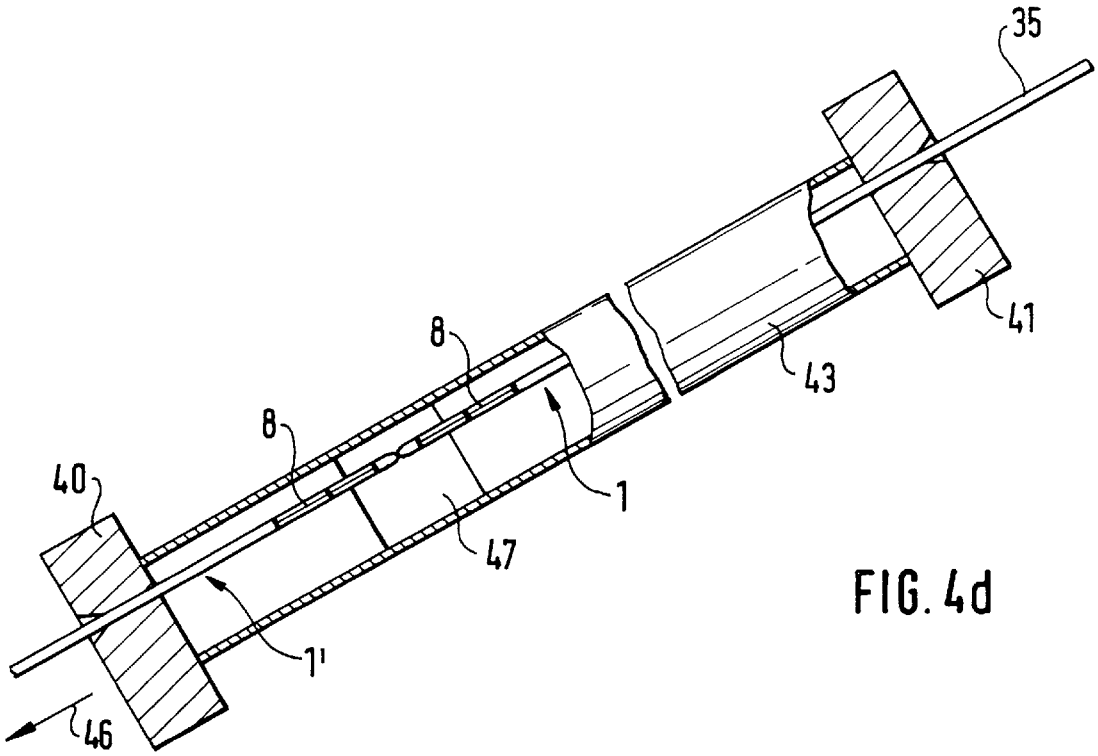

For pushing the strand through the lower anchoring means 40, a second insertion lance 1' of the same construction is used, wherein the insertion lance 1' is pushed in the corresponding manner through the bore 42 in the lower anchoring means 40 and is coupled at a window 47 in the tubing 43 to the first insertion lance 1, as shown in FIG. 4*c*, or, after removing the first insertion lance 1, directly to the strand 35. After changing the expansion members 8 back from the expanded position into the non-expanded position, the strand 35 can also be pushed at the lower anchoring means 40 through the bores 42 in spacer member and anchoring disc, as shown in FIG. 4*d*.

Figure 5A:
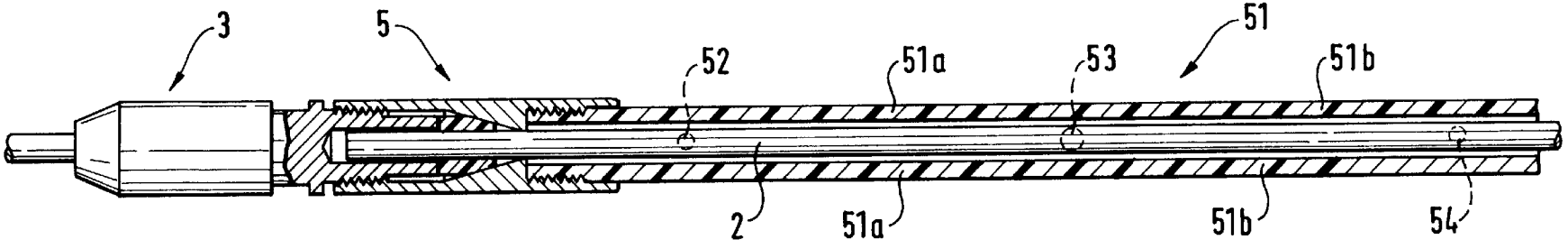
FIGS. 5*a* and 5*b* show another embodiment of the device according to the invention.
Figure 5B:
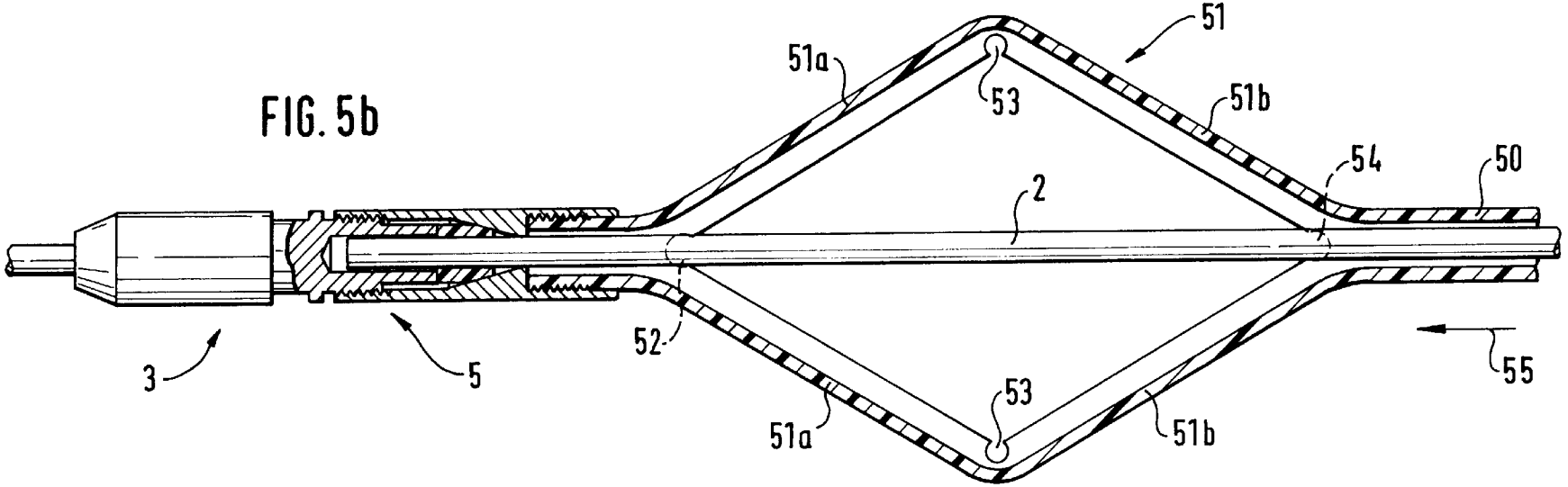

FIGS. 5*a* and 5*b* show another simpler embodiment of an expansion member. The pipe 50 slid onto the guide rod 2 is a pipe of plastic material, for example, polyethylene, which becomes an expansion member 51 by providing it with slots extending in longitudinal direction. The pipe 50 is provided with transverse bores 52, 53 and 54 to produce decreased thickness portions having hinge-like effects, so that, when an axial pressure is applied in the direction of arrow 55 against the tube 50, the pairs of expansion arms 51*a* and 51*b* are expanded in the manner illustrated in FIG. 5*b*. By exerting a pulling force by means of the adjusting element, the pairs of expanding arms 51*a* and 51*b* again rest against the guide rod 2.

The invention is not limited by the embodiments described above which are presented as examples only but can be modified in various ways within the scope of protection defined by the appended patent claims.

I claim:

1. A device in combination with individual tension elements of a freely tensioned tension member for facilitating insertion of the individual tension elements into a tubular sheathing, the device comprising a guide element for attachment to a forward end of one of the individual elements, the guide element comprising an expansion member, and a central guide rod axially extending through the expansion member, at least one coupling element connected by a tension-proof connection to the guide rod, and a threaded sleeve and two tubular connecting members mounted between the expansion member and the at least one coupling element for applying an axial compressive force to the expansion member, wherein the guide rod extends through the connecting members, wherein the connecting members have ends, and wherein the threaded sleeve is screwed with internal threads onto the ends of the connecting members, the expansion member having expanding means movable by the threaded sleeve between an expanded position and a non-expanded position, the expansion member having a diameter in the expanded position of the expanding means and a diameter in the non-expanded position of the expanding means, wherein the diameter in the non-expanded position corresponds approximately to a diameter of said one of the individual elements, while the diameter in the expanded position is greater than the diameter of said one of the individual elements.

2. The device according to claim 1, wherein the expanding means of the expansion member comprise at least two pairs of arms, wherein the arms of each pair are in alignment with each other in the non-expanded position of the expansion member and the arms of each pair extend at an angle relative to each other in a rhomb-like configuration in the expanded position of the expansion member.

3. The device according to claim 2, wherein the expansion member is mounted at an end of the guide rod adjacent to a forward fixed abutment.

4. The device according to claim 3, comprising a pipe for applying an axial force to the expansion member for moving the expanding means between the expanded position and the non-expanded position, wherein the pipe surrounds the guide rod and is slidable in longitudinal direction of the guide rod, and wherein the pipe acts on free ends of the pairs of arms located opposite the abutment.

5. The device according to claim 4, wherein the at least one coupling element has wedge-type anchoring means for the connection to said one of the individual elements.

6. The device according to claim 4, wherein the expanding arms are comprised of rods and hinges for connecting the rods to one another and to the pipe and one of the coupling elements.

7. The device according to claim 2, wherein the expanding arms are portions of a tube of plastic material having longitudinal slots.

8. The device according to claim 1, wherein the expansion member comprises a cover of elastically expandable material.

9. The device according to claim 8, wherein the elastically expandable material is rubber.

10. The device according to claim 1, comprising a connecting element for permitting a relative rotary movement between the guide element and said one of the individual elements.

* * * * *